US007934404B2

(12) United States Patent
Ha

(10) Patent No.: US 7,934,404 B2
(45) Date of Patent: May 3, 2011

(54) DOOR FOR A WASHING OR DRYING MACHINE

(75) Inventor: Young Hoon Ha, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 476 days.

(21) Appl. No.: 11/547,317

(22) PCT Filed: Jan. 20, 2006

(86) PCT No.: PCT/KR2006/000236

§ 371 (c)(1),
(2), (4) Date: Nov. 12, 2008

(87) PCT Pub. No.: WO2006/080788

PCT Pub. Date: Aug. 3, 2006

(65) Prior Publication Data

US 2009/0064593 A1 Mar. 12, 2009

(30) Foreign Application Priority Data

Jan. 25, 2005 (KR) ..... 10-2005-0006687
Jan. 25, 2005 (KR) ..... 10-2005-0006688
Jan. 25, 2005 (KR) ..... 10-2005-0006689

(51) Int. Cl.
*D06F 37/28* (2006.01)

(52) U.S. Cl. ..... 68/196

(58) Field of Classification Search ..... 68/196; 134/200

See application file for complete search history.

(56) References Cited

U.S. PATENT DOCUMENTS

| | | | | | |
|---|---|---|---|---|---|
| 2,317,213 | A | * | 4/1943 | Oliver | 220/849 |
| 2,576,392 | A | * | 11/1951 | Downes | 52/208 |
| 2,706,899 | A | * | 4/1955 | Meyer | 68/23.5 |
| 4,665,628 | A | * | 5/1987 | Clawson | 34/449 |
| 6,228,290 | B1 | * | 5/2001 | Reames et al. | 264/1.7 |
| 7,118,070 | B2 | * | 10/2006 | Abrams et al. | 244/129.3 |

FOREIGN PATENT DOCUMENTS

| | | | |
|---|---|---|---|
| DE | 28 55 032 | * | 7/1980 |
| DE | 8304273 | U1 | 6/1983 |
| DE | 195 15 040 | A1 | 10/1996 |
| EP | 0293984 | A1 | 12/1988 |
| GB | 2 070 130 | * | 9/1980 |
| GB | 2118580 | A | 11/1983 |
| JP | 04-114695 | * | 4/1992 |
| KR | 2003062172 | * | 7/2003 |

OTHER PUBLICATIONS

European Patent Office 0 293 984 Dec. 1988.*

* cited by examiner

*Primary Examiner* — Frankie L Stinson
(74) *Attorney, Agent, or Firm* — McKenna Long & Aldridge LLP

(57) ABSTRACT

The present invention relates to mechanical apparatuses, such as washing machines or dryers, for washing or drying laundry, and more particularly to a door on a mechanical apparatus, in which a window (76) of the door can be mounted on a frame (72) thereof fit thereto, and which can prevent the window from hanging down by gravity. The door includes a formed door frame (80), a rear door frame (90), and a door window. The door window (76) may be a door glass of glass, or transparent plastic. There is a flexible seating rib (102) formed on the front door frame (80) or the rear door frame (80) or the rear door frame (90) for seating and supporting an edge portion (77) of the door window (76).

6 Claims, 14 Drawing Sheets

[Fig. 1]
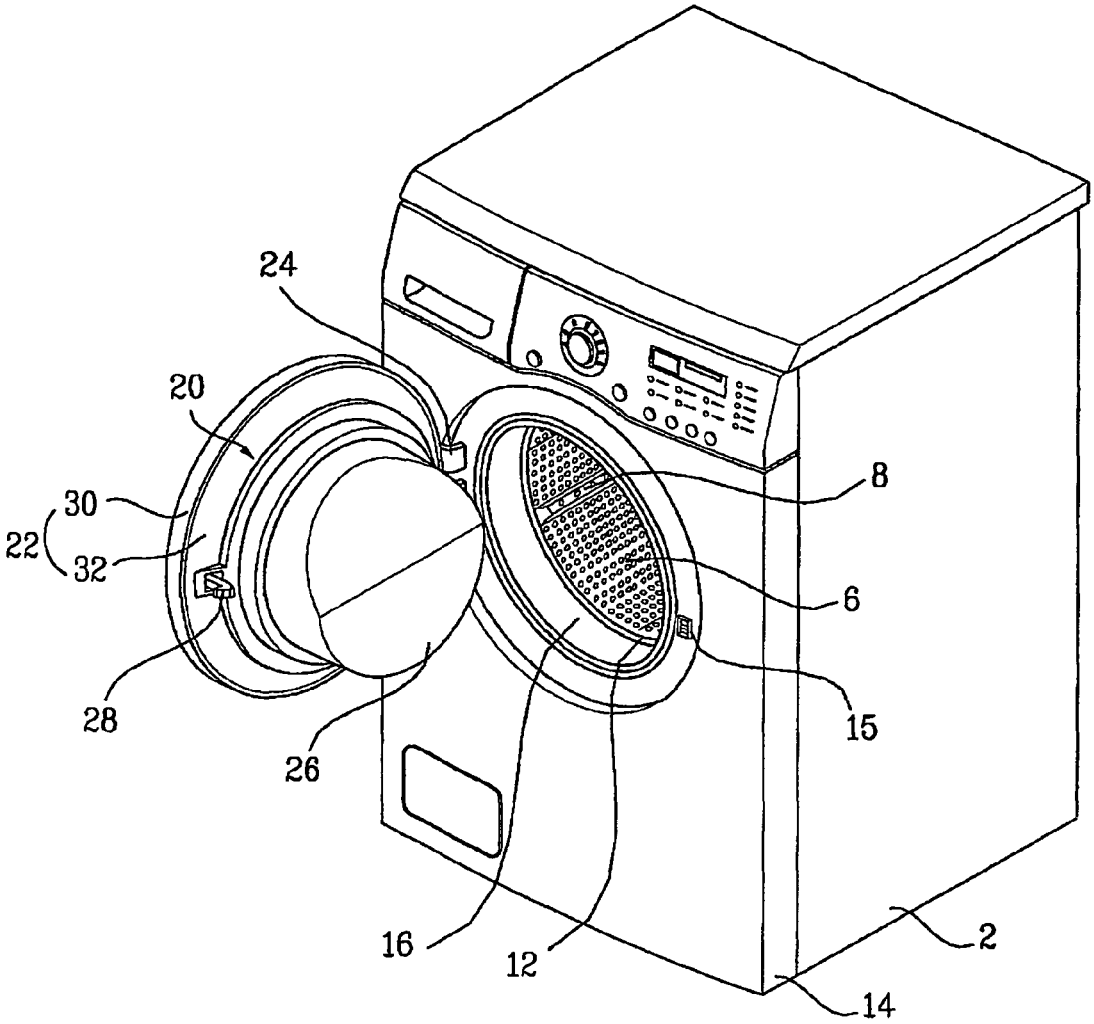

[Fig. 2]
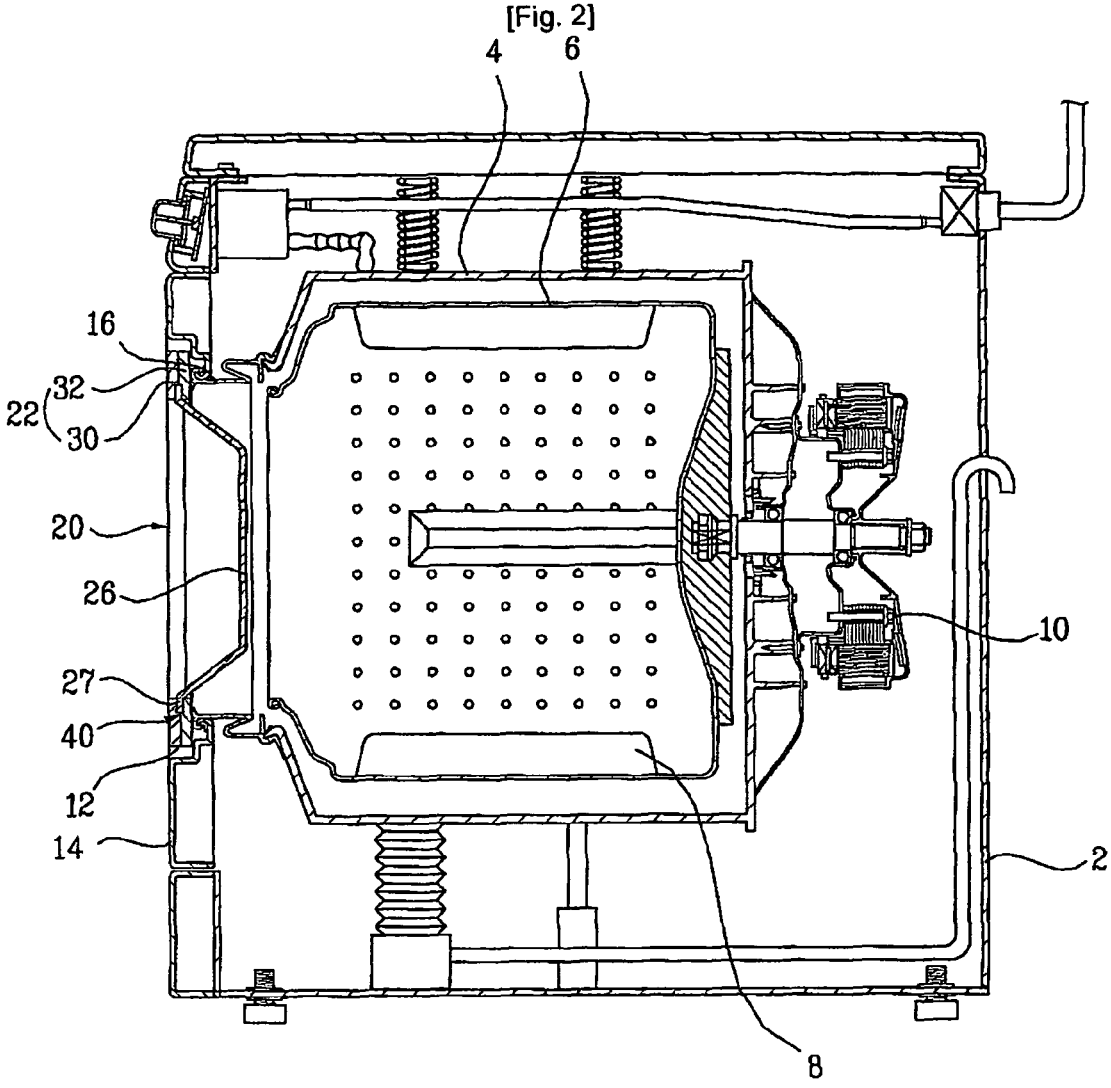

[Fig. 3]
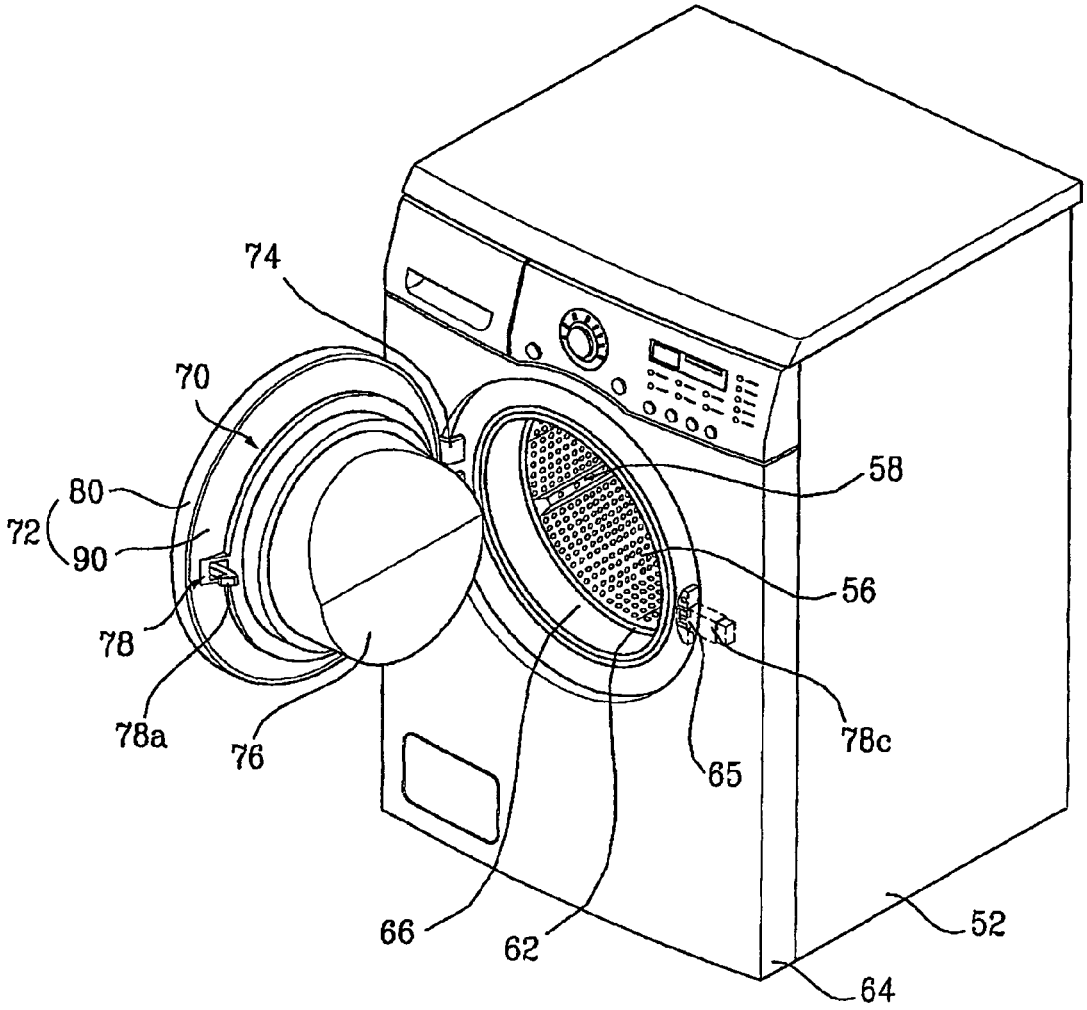

[Fig. 4]
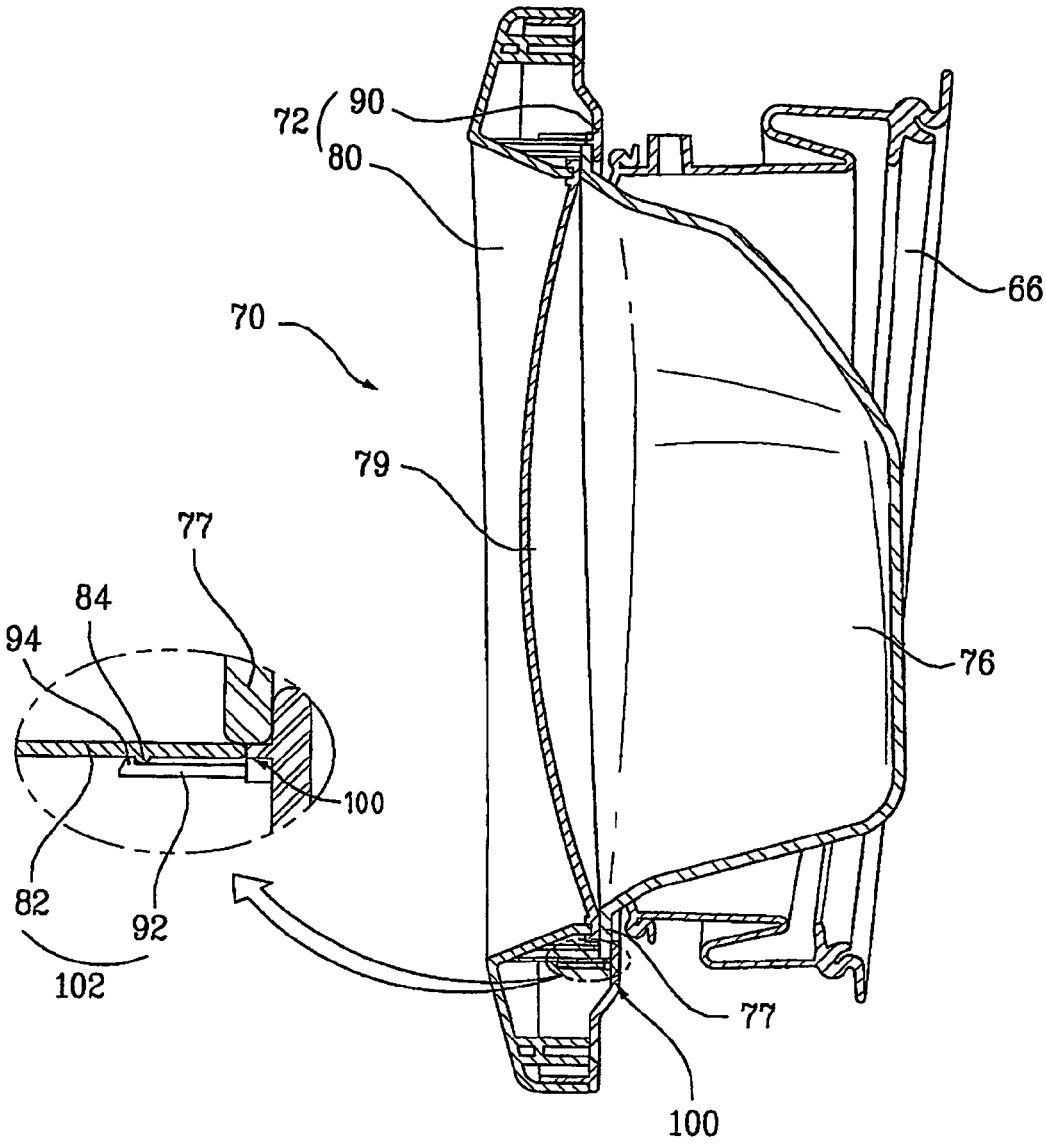

[Fig. 5]
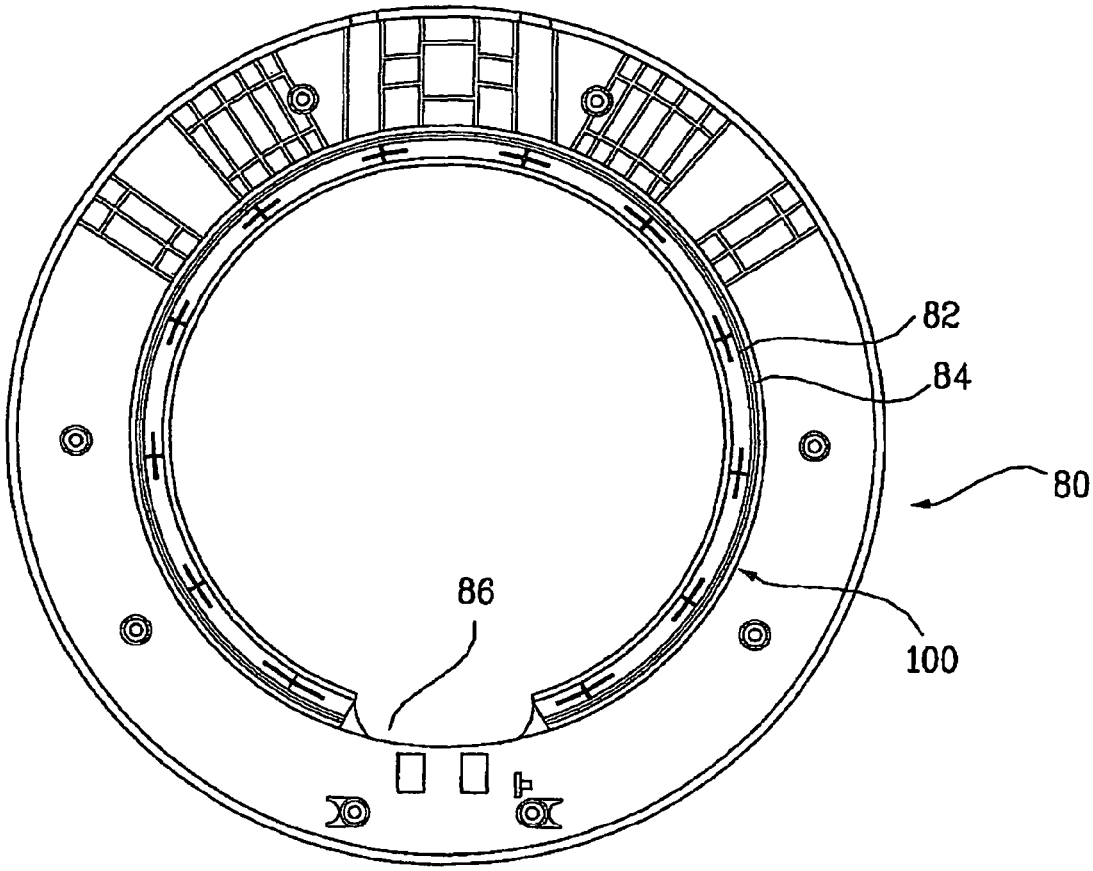

[Fig. 6]
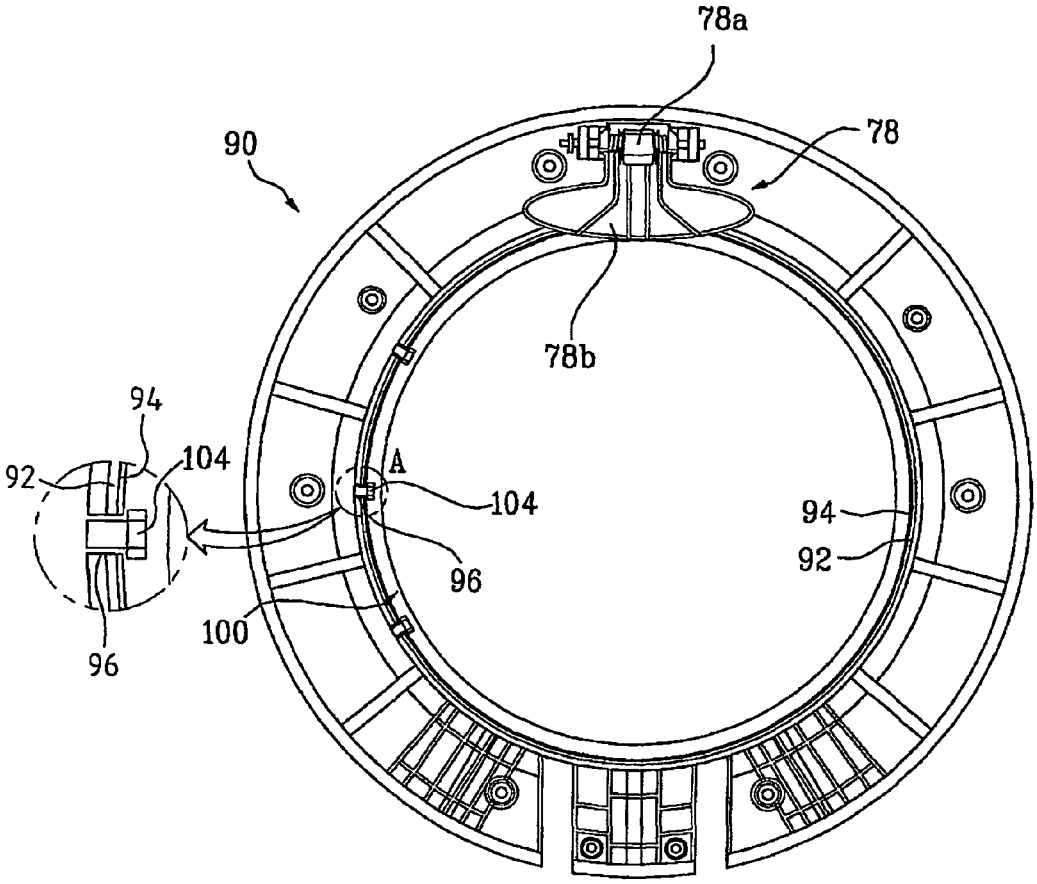
[Fig. 7]
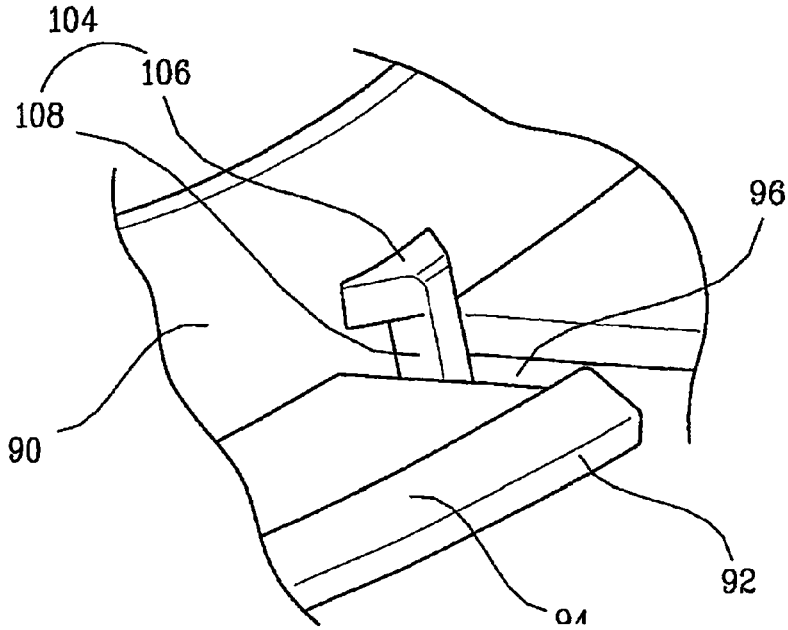

[Fig. 8]
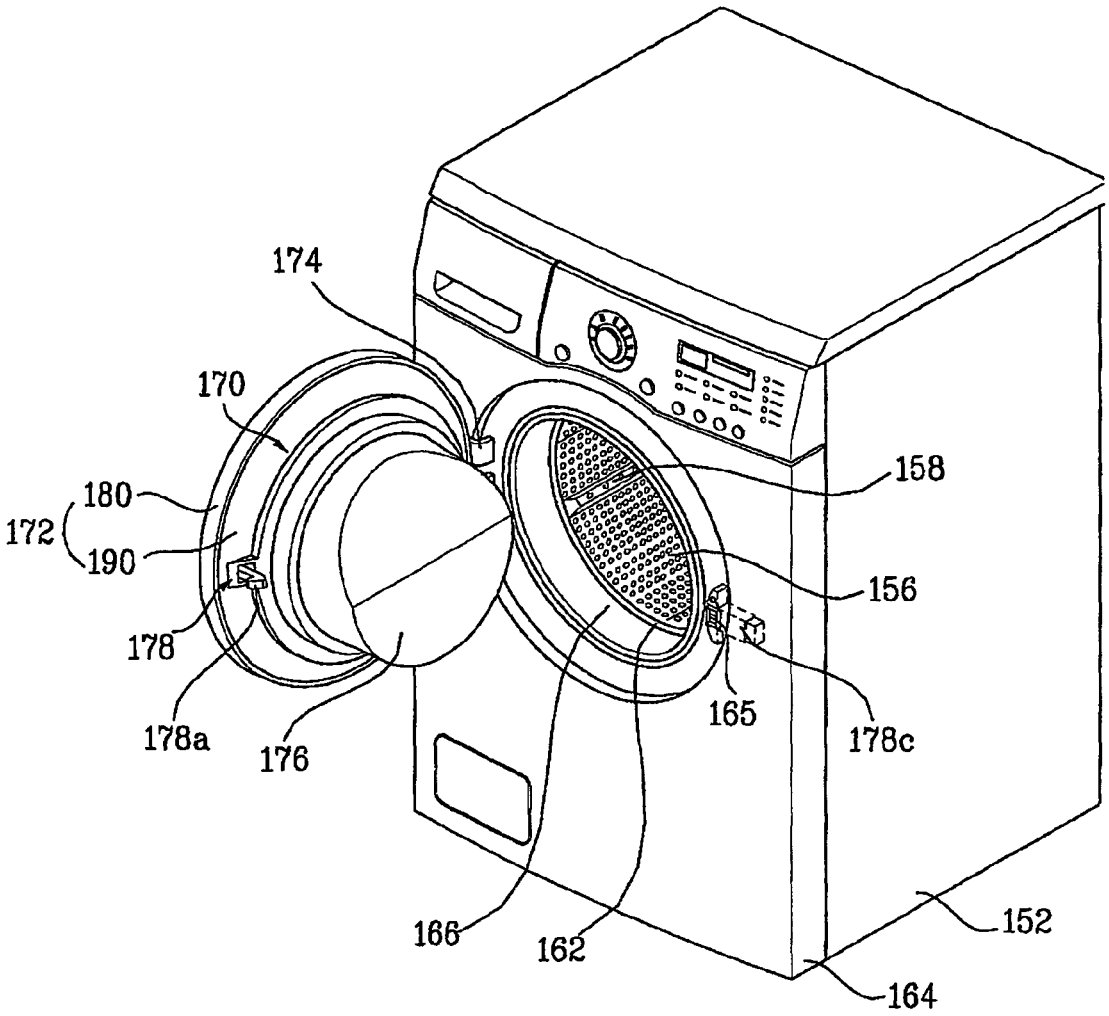

[Fig. 9]
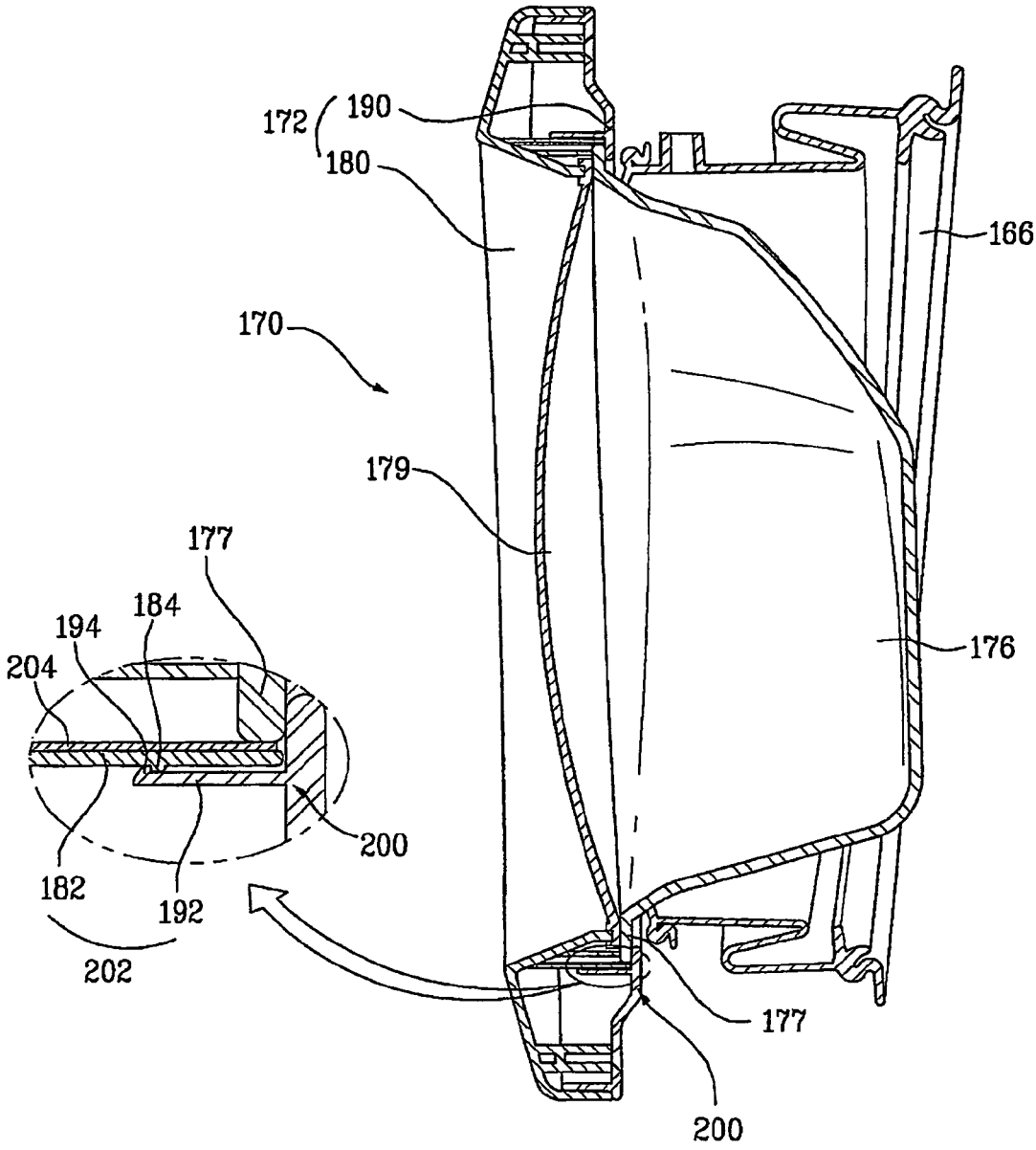

[Fig. 10]
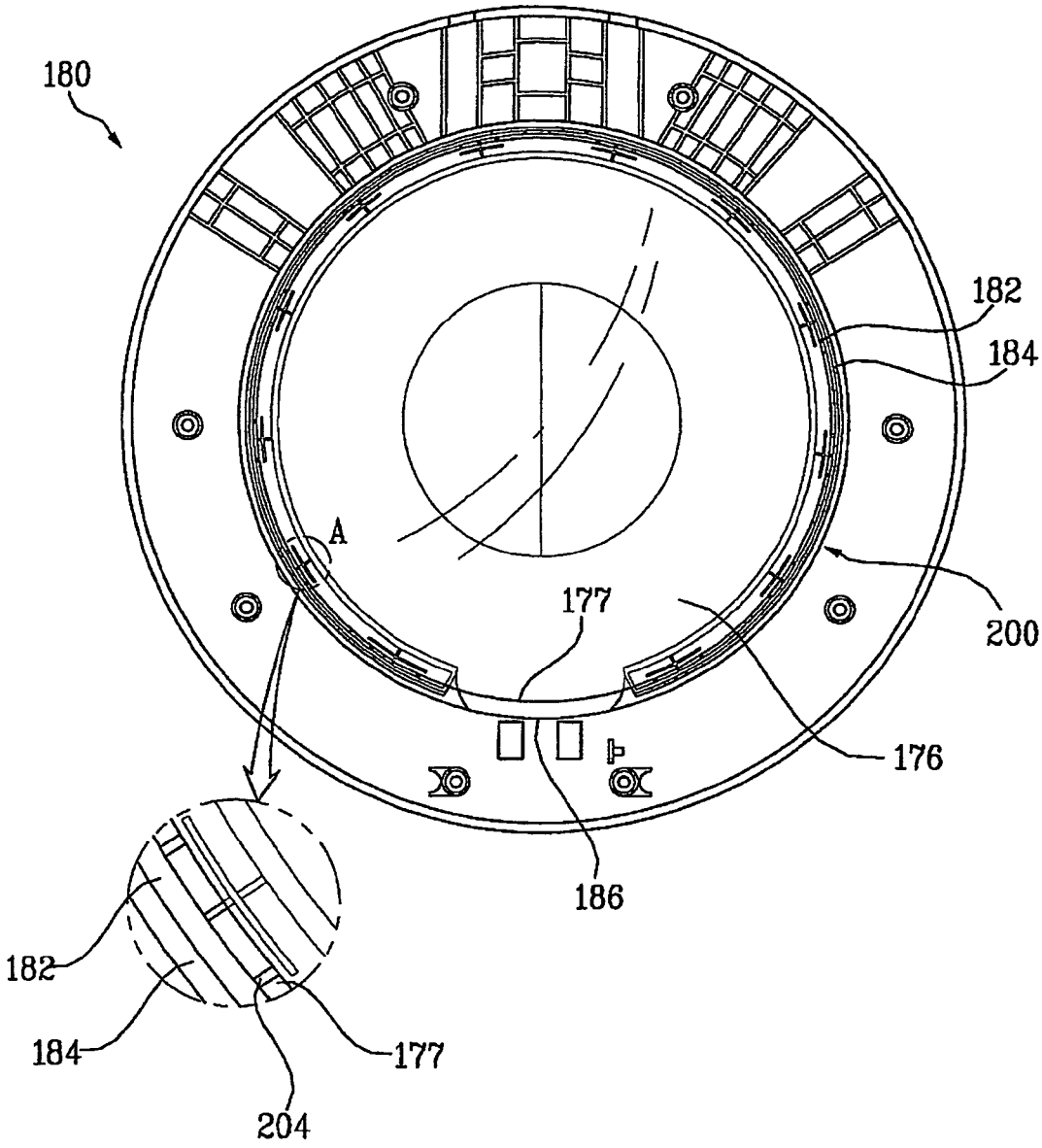

[Fig. 11]
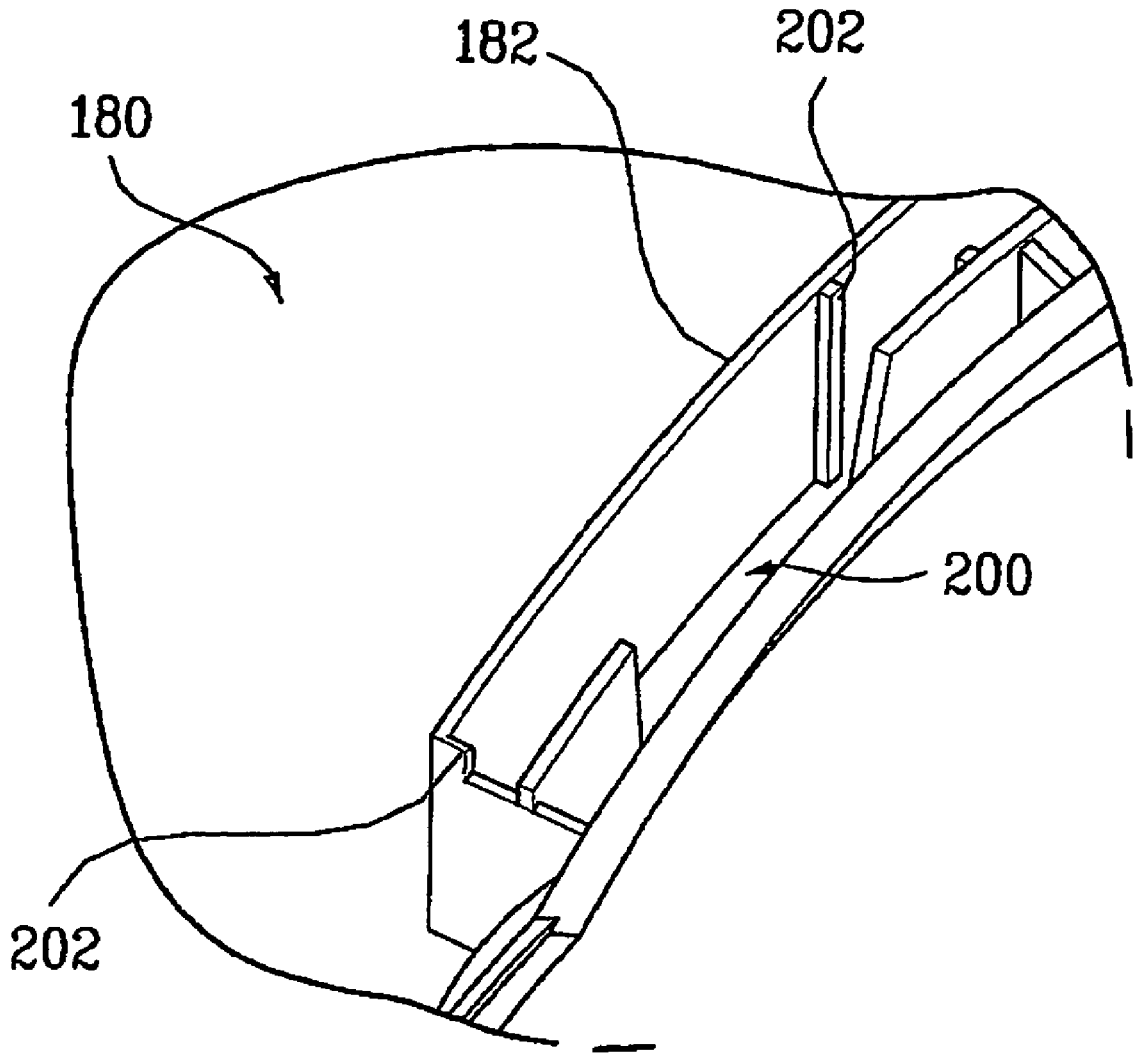

[Fig. 12]
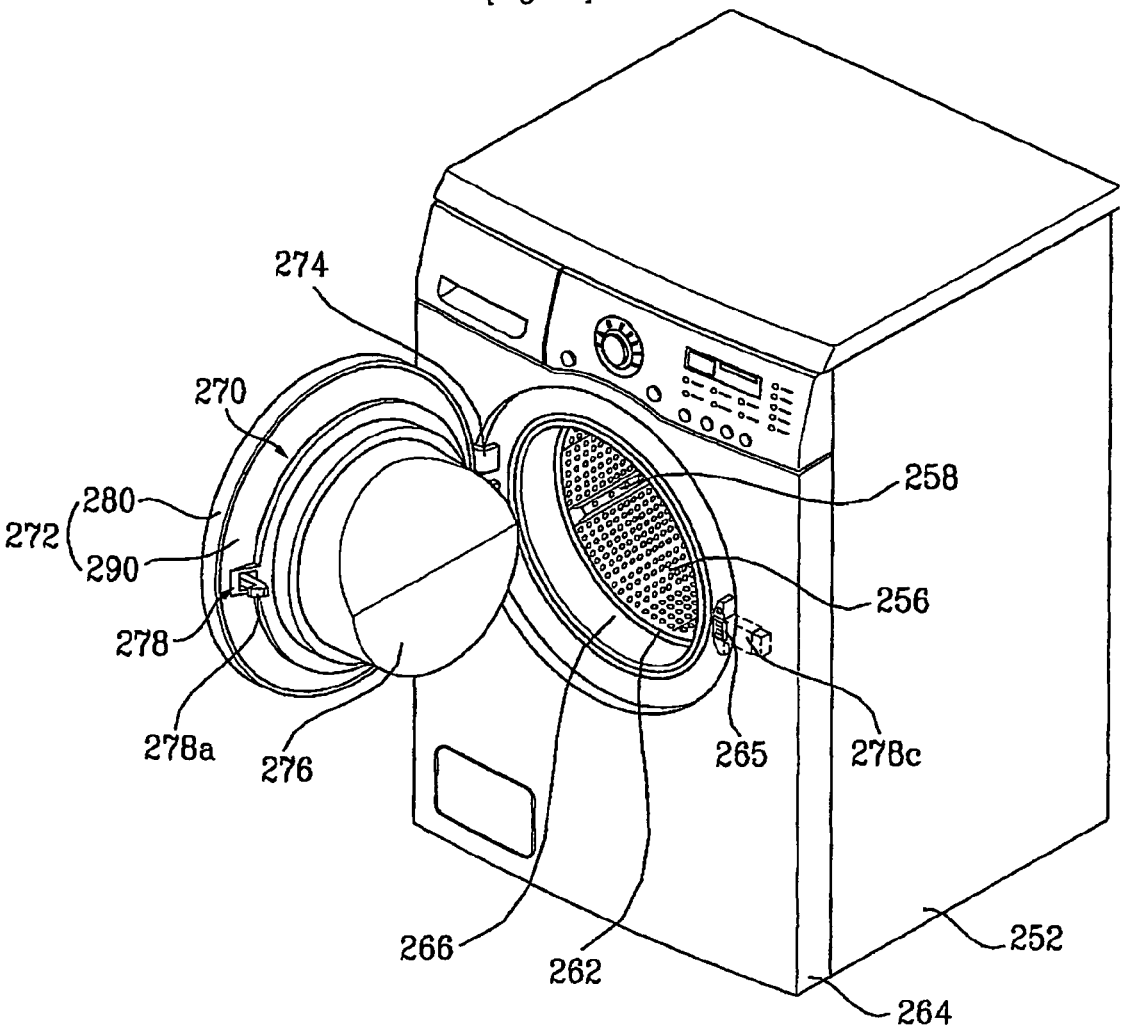

[Fig. 13]
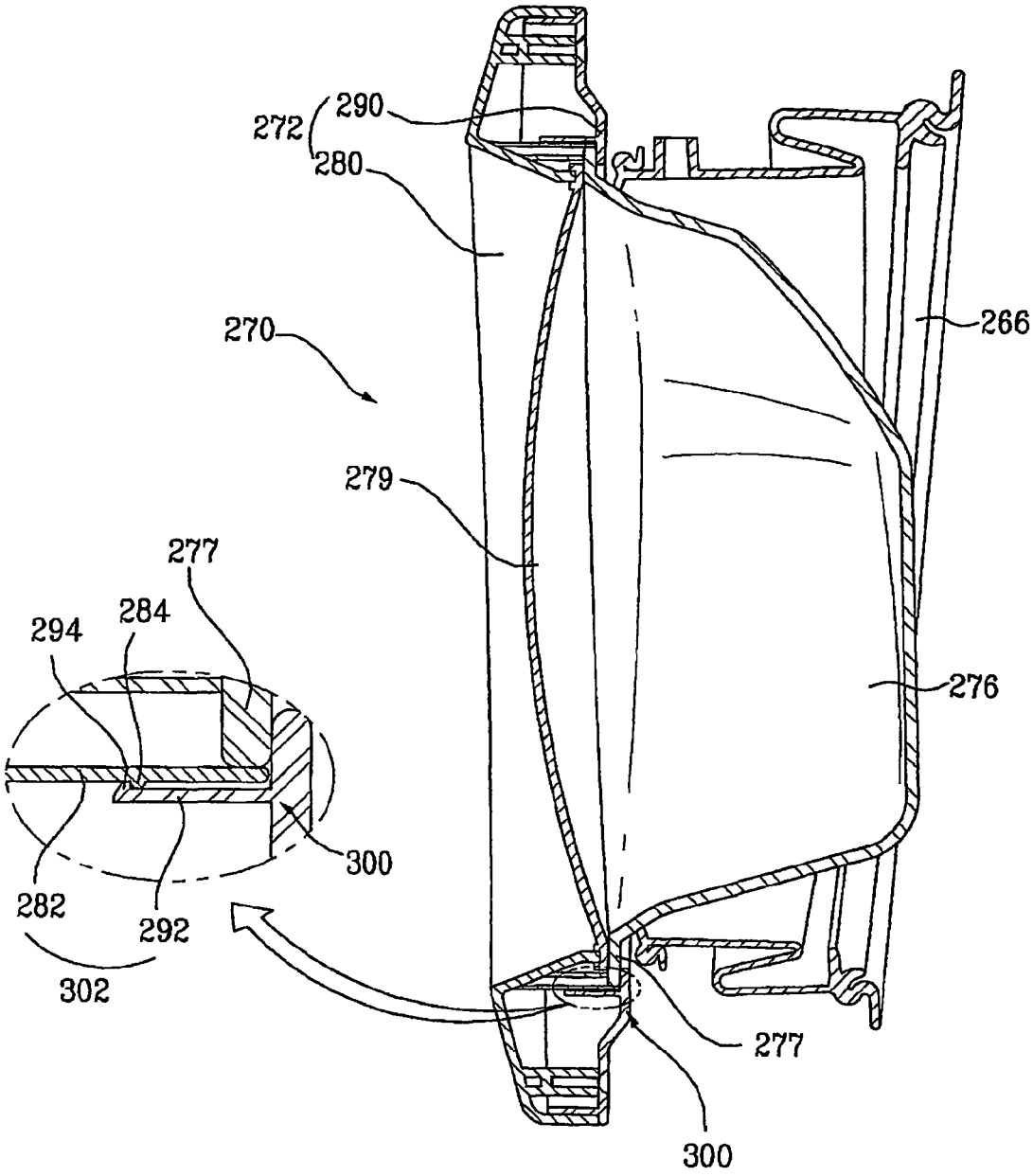

[Fig. 14]
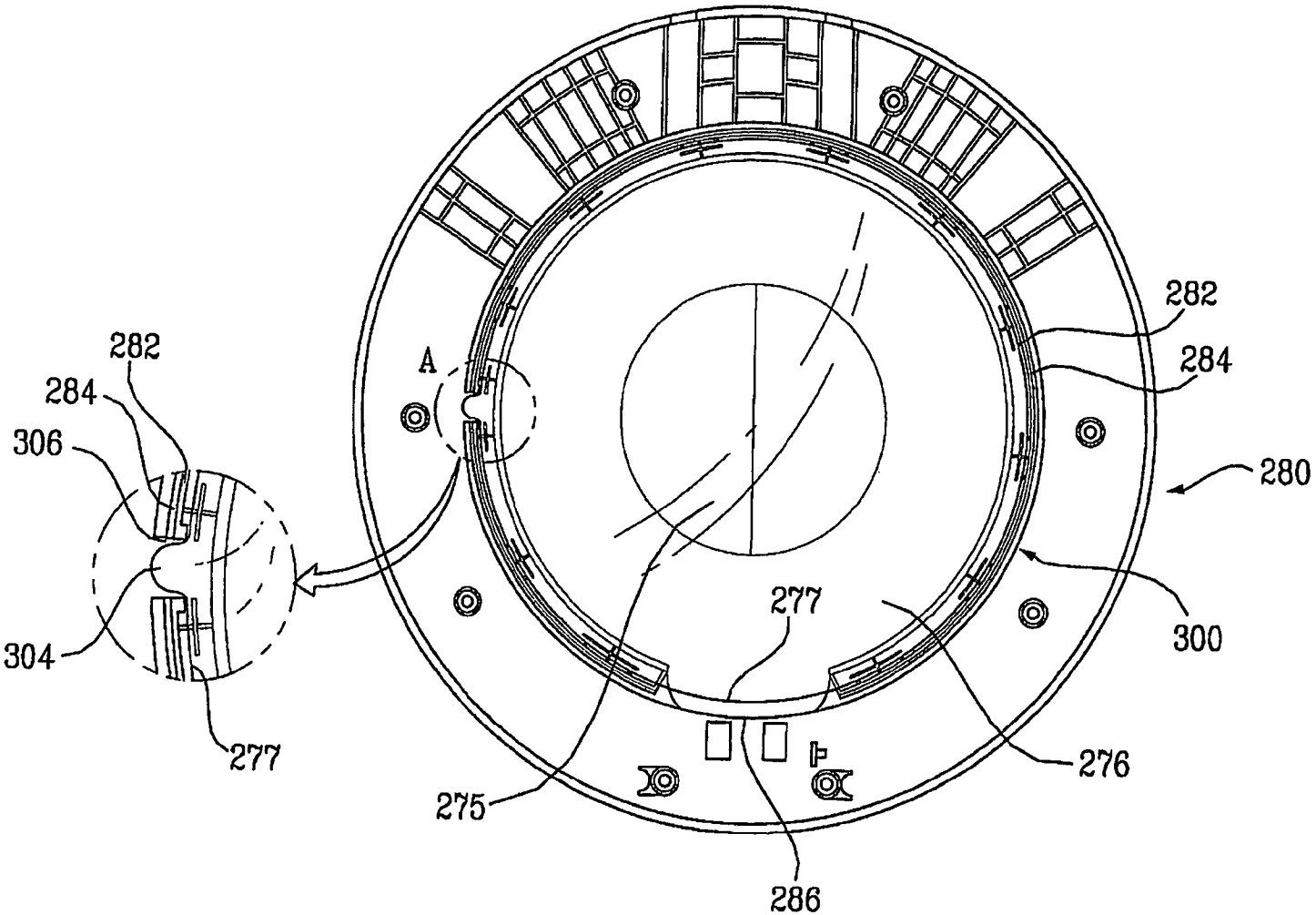

[Fig. 15]
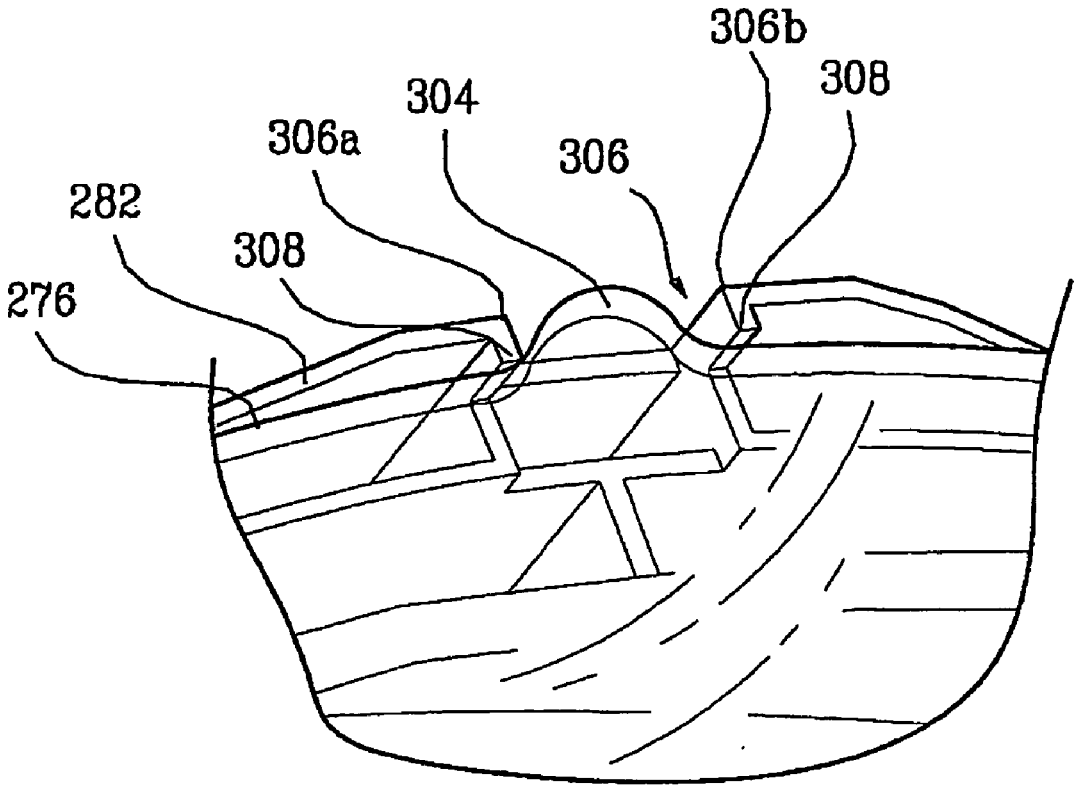

DOOR FOR A WASHING OR DRYING MACHINE

This application claims priority to International Application No. PCT/KR2006/000236, filed on Jan. 20, 2006, Korean Patent application No. 10-2005-0006687, Korean Patent Application No. 10-2005-0006688, and Korean Patent Application No. 0006689, which were filed Jan. 25, 2005 and are hereby incorporated by reference in their entirety.

TECHNICAL FIELD

The present invention relates to mechanical apparatuses, such as washing machines or dryers, for washing or drying laundry, and more particularly to a door on a mechanical apparatus, in which a window of the door can be mounted on a frame thereof fit thereto, and which can prevent the window from hanging down by gravity.

BACKGROUND ART

In general, the washing machine washes laundry by using steps of washing, rinsing, spinning, and so on to remove dirt from clothes and beddings (hereafter called as laundry) by using actions of water and detergent.

Particularly, a drum type washing machine washes laundry in a process of lifting and dropping the laundry as a drum is rotated by driving force of a motor after the detergent, washing water, and the laundry is introduced in the drum mounted in a horizontal direction, shows no entangling of the laundry, and has a low water consumption and a washing effect of pounding and rubbing the laundry.

In the meantime, the dryer is a mechanical apparatus for drying wet laundry. A drying object in a drum of the dryer is dried by hot air supplied thereto. In general, the dryer is provided with the drum for holding the laundry, a heater for heating air, and a blower for blowing heated air to the drum.

The dryer and the washing machine may be provided individually, or a dryer and washing machine may also be provided.

The washing machine or the dryer is provided with a door for putting in/taking out the laundry therein/therefrom, wherein the door is provided with a door window for determination of a laundry state. The present invention relates to the door.

FIGS. 1 and 2 each illustrates a related art drum type washing machine having a door window provided thereto. The door provided to the related art washing machine or dryer will be described with reference to FIGS. 1 and 2.

Referring to FIG. 1 or 2, the related art drum type washing machine is provided with a cabinet 2 forming an exterior of the drum type washing machine, a tub 4 suspended in the cabinet 2, a drum 6 in the tub 4 for washing the laundry, lifters 8 on an inside surface of the drum 6 for lifting the laundry such that the laundry falls down from a predetermined height by gravity, a motor 10 at a rear of the tub 4 for generating power, a cabinet cover 14 on a front of the cabinet 2 having a laundry opening 12 at a center for putting in/taking out the laundry, and a door 20 on the cabinet cover 14 for opening/closing the laundry opening to prevent the laundry from breaking away from the washing machine.

Between the laundry opening 12 of the cabinet cover 14 and the tub 4, there is a gasket 16 for serving as a packing to attenuate impact from rotation of the drum 6 and prevent the washing water from overflowing to an outside of the washing machine.

In the meantime, the door 20 is provided with an annular door frame 22 for opening/closing the laundry opening 12 in the cabinet cover 14, a door hinge assembly 24 having two ends fixedly secured to the door frame 22 and the cabinet cover 14 at one sides thereof for rotatably supporting the door frame 22 on the cabinet cover 14, a door glass 26 at a center opening of the door frame 22 for making an inside of the drum visible, and a door hook assembly 28 projected from the other side of the door frame 22 for hooking at a hook hole 15 in the cabinet cover 14 when the door 20 is closed.

The door frame 22, an injection molding of a synthetic resin, has an annular front door frame 30 which forms a front of the door 20, and an annular rear door frame 32 mounted to a rear of the front door frame 30.

The door glass 26 has an edge portion 27 held between the front door frame 30 and the rear door frame 32 for closing the center opening of the door frame 22.

On inner sides of the front door frame 30 and the rear door frame 32, there are seating portions 40 for seating the edge portion 27 of the door glass 26 in a circumferential direction, respectively.

After the edge portion 27 of the door glass 26 is seated on the seating portion 40 at a rear of the front door frame 30, and the door hinge assembly 24 and the door hook assembly 28 are mounted to one side and the other side of the front door frame 30, the rear door frame 32 is mounted to the rear of the front door frame 30.

In this instance, because the front door frame 30 and the rear door frame 32 are in close contact with a front surface and a rear surface of the edge portion 27 of the door glass 26, front/rear direction movement of the door glass 26 is prevented and the seating portion 40 prevents the door glass 26 from moving in up/down, left/right direction.

However, the fabrication tolerances of the seating portion 40 and the edge portion 27 of the door glass 26 cause a problem.

For an example, if it is assumed that the seating portion 40 is formed without tolerance, mounting of the door glass 26 is difficult if the edge portion 27 has a diameter with a '+' tolerance. Opposite to this, if the edge portion 27 has a diameter with a '−' tolerance, even though it is possible to mount the door glass 26, the door glass 26 is liable to move within the seating portion 40.

DISCLOSURE OF INVENTION

Technical Problem

An object of the present invention lies on solving the related art problem.

Moreover, the present invention suggests a seating structure for holding the door window, such as a door glass, positively.

Furthermore, the present invention suggests a seating structure for guiding mounting of the door window in mounting the door window in a predetermined direction, and preventing the door window from rotating after the mounting.

Technical Solution

The door of the present invention includes a front door frame, a rear door frame, and a door window. The door window may be a door glass of glass, or transparent plastic. The door window may be formed of any material and any shape as far as the door window is transparent to make an inside visible, and meets a required function.

There is a flexible seating rib formed on the front door frame or the rear door frame for seating and supporting an edge portion of the door window.

The seating rib may be formed such that an entire circumference or a portion of the door window is seated thereon. Preferably, the seating rib is formed to support the door window not only in up/down directions, but also in left/right directions.

The edge portion of the door window fits in the seating rib. Preferably, the edge portion of the door window has a '+' tolerance, for placing the edge portion on the seating rib while the edge portion deforms the seating rib.

Even in a case placing of the door window on the seating rib is difficult due to '+' tolerance of the edge portion, the deformation absorbs the tolerance, enabling the placing of the door window. In such a placed state, the seating rib holds the door window positively by an elastic force of the deformation.

Preferably, the seating rib includes a front seating rib and a rear seating rib. The front seating rib is formed on the front door frame, and the rear seating rib is formed on the rear door frame. The edge portion of the door window is seated, and supported on the front seating rib, and the rear seating rib supports the front seating rib.

By providing the front seating rib and the rear seating rib to the seating rib, strength and rigidity of the seating rib is reinforced. If the seating rib is flexible excessively, the door window is liable to hang down by gravity.

Therefore, the provision of the front seating rib and the rear seating rib to the seating rib enables to solve the problem of the hang down of the door window.

Particularly, if the door glass is formed of glass, with heavy weight of the door window, the hang down caused by gravity can not be overlooked. However, if the door window is formed of transparent plastic, the problem of hang down may not take place as the weight is not heavy.

If the door window hangs down by above reason, a gap can be formed between the door window and the gasket 16 (see FIG. 1 or 2) on an upper side, causing leakage of washing water therethrough.

Preferably, the front door frame, or the rear door frame has door window supporting means, additionally. The door window supporting means supports an edge portion of the door window for preventing the door window from hanging down.

The door window supporting means can support the door window without permitting deformation, substantially. While the seating rib permits a required level of deformation, the door window supporting means is formed not to permit the deformation, for preventing the door window from hanging.

Moreover, the door window supporting means may be seating ribs formed on a lower side of at least one of the front seating rib and the rear seating rib.

It is preferable that the seating rib is formed in a cut away slot from the lower sides of the front seating rib and the rear seating rib as regular intervals.

It is preferable that a plurality of the seating ribs are formed along the lower sides of the front seating rib and the rear seating rib at predetermined intervals, respectively.

The seating rib includes a supporting portion for seating and supporting the edge portion of the door window, and a reinforcing portion at one side of the supporting portion for reinforcing strength of the supporting portion.

In the meantime, the seating rib may have a reinforcing rib formed thereon. The reinforcing rib reinforces strength or rigidity of the seating rib, thereby preventing the excessive flexibility of the seating rib.

The reinforcing rib may, or may not be used together with the door window supporting means. The problem of the hanging down of the door window by gravity can be solved only with the reinforcing rib as much as required.

In the meantime, a door in another aspect of the present invention includes a structure for preventing the door window from rotating after the door window is mounted.

In order to prevent the door window from rotating, a frame side rotating preventive structure is formed on the front door frame or the rear door frame, and a door window side rotation preventive structure is formed on the door window.

The door window side rotation preventive structure and the frame side rotation preventive structure prevent the door window from rotating in association with each other.

Preferably, the rotation preventive structure includes simple recess and projection.

That is, one of the frame side rotation preventive structure and the door window side rotation preventive structure includes a rotation preventive recess, and the other one thereof includes a rotation preventive projection for placing in the rotation preventive recess.

The rotation preventive structure also guides mounting of the door window. In a case if it is required that the door window is mounted with an orientation in up/down and left/right directions, above structure guides the door window to mount according to the orientation.

More preferably, the rotation preventive structure and the seating rib may be combined. That is, the rotation preventive recess is formed on one of the seating rib and the door window, and the rotation preventive projection is formed on the other one.

The mounting of the door window with orientation has an important service other than the smooth mounting of the door window. The tolerance of the frame seating structure or the door window, nature and position of the tolerance can be consistent, if the tolerance comes from the same reason in view of fabrication or structure.

For an example, the edge portion of the circular door window may have a left/right direction diameter greater than an up/down direction diameter or vice versa. In such a case too, mounting of the door window may not be possible if the up/down direction or the left/right direction are not maintained. In this case, the recess and the projection serves as a guide of the mounting.

Advantageous Effects

The present invention can solve the related art problem.

Assembly of the door window and the door frame is made possible even if the assembly is difficult due to fabrication tolerance or the like. Moreover, the door window can be supported positively without hanging by gravity. Furthermore, mounting of the door window is guided to mount the door window according to designated direction, and the door window does not rotate after the mounting.

BRIEF DESCRIPTION OF THE DRAWINGS

FIG. 1 illustrates a perspective view of a drum type washing machine having a related art door provided thereto;

FIG. 2 illustrates a section of a drum type washing machine having a related art door provided thereto;

FIG. 3 illustrates a perspective view of a drum type washing machine having a door in accordance with a preferred embodiment of the present invention provided thereto;

FIG. 4 illustrates a section of a drum type washing machine having a door in accordance with a preferred embodiment of the present invention provided thereto;

FIG. 5 illustrates a back view of a front door frame of a door in accordance with a preferred embodiment of the present invention;

FIG. 6 illustrates a front view of a rear door frame of a door in accordance with a preferred embodiment of the present invention;

FIG. 7 illustrates a perspective view of the holding rib in FIG. 6;

FIG. 8 illustrates a perspective view of a drum type washing machine having a door in accordance with another preferred embodiment of the present invention provided thereto;

FIG. 9 illustrates a section of the door in FIG. 8;

FIG. 10 illustrates a plan view showing a state a door glass is mounted on the front door frame in FIG. 9;

FIG. 11 illustrates an enlarged perspective view of "A" in FIG. 10;

FIG. 12 illustrates a perspective view of a drum type washing machine having a door in accordance with another preferred embodiment of the present invention provided thereto;

FIG. 13 illustrates a section of the door in FIG. 12;

FIG. 14 illustrates a plan view showing a state a door glass is mounted on the front door frame in FIG. 13;

FIG. 15 illustrates an enlarged perspective view of "A" in FIG. 14;

DESCRIPTION OF SYMBOLS FOR KEY PARTS IN THE DRAWINGS

52: cabinet 56: drum
58: lifter 62: laundry opening
64: cabinet cover 65: hook hole
66: gasket 70: door
72: door frame 74: door hinge assembly
76: door glass 78: door hook assembly
79: safety cover 80: front door frame
82: front seating rib 84: first stopper
86: hand grip 90: rear door frame
92: rear seating rib 94: second stopper
96: cut away slot 100: seating portion
102: seating rib 104: glass supporting means, supporting rib
106: supporting portion 108: reinforcing portion

BEST MODE FOR CARRYING OUT THE INVENTION

Reference will now be made in detail to the preferred embodiments of the present invention, examples of which are illustrated in the accompanying drawings.

FIG. 3 illustrates a perspective view of a drum type washing machine having a door in accordance with a preferred embodiment of the present invention provided thereto, FIG. 4 illustrates a section of a drum type washing machine having a door in accordance with a preferred embodiment of the present invention provided thereto, FIG. 5 illustrates a back view of a front door frame of a door in accordance with a preferred embodiment of the present invention, FIG. 6 illustrates a front view of a rear door frame of a door in accordance with a preferred embodiment of the present invention, and FIG. 7 illustrates a perspective view of the holding rib in FIG. 6.

As shown, the drum type washing machine includes a cabinet 52 forming an exterior of the drum type washing machine, a tub (not shown) in the cabinet 52, a drum 56 rotatably mounted in the tub 4 for holding the laundry, lifters 58 on an inside surface of the drum 56 for lifting the laundry such that the laundry falls down from a predetermined height by gravity, a motor (not shown) at a rear of the tub for driving the drum 56, a cabinet cover 64 on a front of the cabinet 52 having a laundry opening 62 at a center for putting in/taking out the laundry, and a door 70 rotatably mounted on the cabinet cover 64 for opening/closing the laundry opening 62 to prevent the laundry from breaking away from the washing machine, and various accidents liable to be caused by negligence of safety from taking place.

Between the laundry opening 62 of the cabinet cover 64 and the tub 4, there is a gasket 66 for serving as a packing to attenuate impact from rotation of the drum 56 and prevent the washing water from overflowing to an outside of the washing machine.

In the meantime, referring to FIGS. 3 to 7, the door includes an annular door frame 72 for opening/closing the laundry opening 62 in the cabinet cover 64, a door hinge assembly 74 having two ends fixedly secured to the door frame 72 and the cabinet cover 64 at one sides thereof for rotatably supporting the door frame 72 on the cabinet cover 64, a door glass 76 at a center opening of the door frame 72 for making an inside of the drum 56 visible, and a door hook assembly 78 projected from the other side of the door frame 72 for hooking at a hook hole 65 in the cabinet cover 64 when the door 70 is closed.

The door frame 72, an injection molding of a synthetic resin, has an annular front door frame 80 which forms a front of the door 70, and an annular rear door frame 90 mounted to a rear of the front door frame 80.

In general, for improving beauty, an outside of the front door frame 80 is plated and a hand grip 86 is provided to a front of the front door frame 80, for user's holding at the time of opening/closing of the door 70.

The door glass 76 has an edge portion 77 held between the front door frame 80 and the rear door frame 90 for closing the center opening of the door frame 72.

The door glass 76 enables the user to see an inside of the drum 56 during the drum type washing machine is in operation, and prevents washing water in the drum 56 from leaking, or the laundry from being seized.

In front of the door glass 76, a safety cover 79 is arranged. The safety cover, not only protects the door glass 76 from an external impact, and but also prevents the user suffering from a burn caused by heated door glass during drying, or boiling washing.

The edge portion 77 of the door glass is compressed and held by the front door frame 80 and the rear door frame 90 as the edge portion 77 is seated in seating portions 100 formed in an inside circumferences of the front door frame 80 and the rear door frame 90 such that the door glass 76 is arranged between the front door frame 80 and the rear door frame 90, and the front door frame 80 and the rear door frame 90 are fastened with fastening members (not shown).

The seating portion 100 includes seating ribs 102 formed on a front surface of the front door frame 80 and on a rear surface of the rear door frame 90 in circumferential directions respectively, so that the door glass 76 is arranged on an inside of the seating ribs 102 and a circumference of the edge portion 77 of the door glass 76 is in contact with an inside surface of the seating ribs 102.

The seating rib 102 includes a front seating rib 82 formed on the rear of the front door frame 80 along a circumference thereof in a circumferential direction, and a rear seating rib 92 formed on the front of the rear door frame 90 along a circumference thereof in a circumferential direction so as to be placed in, and fit to the front seating rib 82.

The front seating rib 82 is projected backward from the rear of the front door frame 80 at a predetermined height, as well as forms a circle along the front door frame 80, and has the circumference of the edge portion 77 of the door glass 76 in contact with an inside surface thereof.

The rear seating rib 92 is projected forward from the front of the rear door frame 90 at a predetermined height, as well as forms a circle along the rear door frame 90, and has an outside surface of the front seating rib 82 in close contact with an inside surface thereof.

That is, the front seating rib 82 is placed in, and fit to the rear seating rib 92 as the front door frame 80 and the rear door frame 90 are coupled.

The front seating rib 82 has a first stopper 84 projected outwardly from an outside surface along a circumference thereof, and the rear seating rib 92 has a second stopper 94 projected inwardly from an inside surface along a circumference thereof for holding the first stopper 84. As the first stopper 84 and the second stopper 94 are held together, the breaking away of the front seating rib 82 and the rear seating rib 92 is prevented. Moreover, owing to interaction of the stoppers 84 and 94, the rear seating rib holds the front seating rib.

The door hook assembly 78 includes a hook 78*a* projected from the other side of the rear door frame 90 for placing in a hook hole 65 in the cabinet cover 64 when the door 70 is closed, a handle 78*b* positioned at the hand grip 86 for rotating a hook 78*a* by the user, and a door switch 78*c* in rear of the hook hole 65 of the cabinet cover 64, for holding the hook 78*a* in the hook hole 65 for maintaining a closed state of the door 70 if required.

In the meantime, both the front seating rib 82 and the rear seating rib 92 are formed thin so that no shrinkage imbalance is caused in injection molding of the door frame 72, and form circles along circumferences and elongated in a direction perpendicular to surfaces of the frames. In this case, the front seating rib 82 and the rear seating rib 92 ray have strength or rigidity not enough to support a weight of the door glass 76, adequately. At one side of the rear seating rib 92, there is glass supporting means formed additionally as door window supporting means for supporting of the weight of the door glass 76, adequately.

The glass supporting means 104 is seating ribs 104 injection molded as one body with the rear door frame 90 at a lower edge, for supporting a lower side of the door glass 76 with the front seating rib 82, to prevent the door glass 76 from hanging caused by deformation of the front seating rib 82 and the rear seating rib 92 by gravity of the door glass 76.

Because the lower side of the door glass 76 is supported on the seating ribs 104 and the front seating rib 82, the seating ribs 104 are formed at the lower side of the front of the rear door frame 90 in conformity with the front seating rib 82, and an end of the front seating rib 82 is spaced from the front of the rear door frame 90 as much as the projected height of each of the seating ribs 104.

According to this, the lower side edge portion 77 of the door glass 76 is placed, and supported on the seating ribs 104 and a tip of the front seating rib 82.

The rear seating rib 92 has cut away slots 96 at regular intervals, in which the seating ribs 104 are formed respectively.

A plurality of the seating ribs 104 are formed at the lower side of the rear door frame 90 at predetermined angular intervals for secure supporting of the lower side of the door glass 76.

That is, the plurality of the seating ribs 104 are formed along the rear seating rib 92, for secure seating, and supporting the lower edge portion of the door glass 76 at many positions.

The seating rib 104 includes a supporting portion 106 for seating, and supporting the edge portion 77 of the door glass 76, and a reinforcing portion 108 at one side of the supporting portion 106 for reinforcing strength of the supporting portion 106.

The supporting portion 106 is projected at a minimum height for enabling secure seating of the edge portion 77 of the door glass 76 with a triangular shape of the projection having a tip portion which becomes the smaller as it goes toward an end the more, for enhancing supporting capability for the door glass 76.

The reinforcing portion 108 is formed between a lower side of the supporting portion 106 and the front of the rear door frame 90 for enhancing a supporting capability for the supporting portion 106.

A process for assembling, and effects of, the door for a drum type washing machine in accordance with the present invention will be described.

After placing the safety cover 79 on a rear of the front door frame 80, the door glass 76 is placed on the rear of the safety cover 79.

In this instance, for placing the safety cover 79 and the edge portion 77 of the door glass 76 on the front door frame 80, the safety cover 79 and the edge portion 77 are placed on an inside of the front seating rib 82 at the rear of the front door frame 80.

Then, the door hinge assembly 74 is fastened to one side of the front door frame 80 having the safety cover 79 and the door glass 76 placed thereon, and the door hook assembly 78 is fastened to the other side of the front door frame 80.

Then, as the rear door frame 90 is fastened to the rear of the front door frame 80 with fastening members, assembly of the door 70 is finished.

As the front door frame 80 and the rear door frame 90 are assembled together, the front seating rib 82 is placed in the rear seating rib 92 of the rear door frame 90, and held by the first stopper 84 of the front seating rib 82 and the second stopper 94 of the rear seating rib 92.

In this instance, the tips of the seating ribs 104 of the rear door frame 90 are in close contact with an end of the front door frame 80, to surround the edge portion 77 of the door glass 76.

In the meantime, if the door hinge assembly 74 is connected to the cabinet cover 64 to mount the door 70 on the drum type washing machine rotatably, weight of the door glass 76 acts on the front seating rib 82 and the seating ribs 104 under the door glass 76.

Though the door glass 76 of glass is very heavy, the front seating rib 82, the rear seating rib 92, and the seating ribs 104 can support the door glass 76, securely.

Particularly, in comparison to the related art, because a rigidity of the door glass 76 supporting structure is enhanced by the seating ribs 104, deformation of the door glass 76 caused by weight of the door glass 76 can be prevented.

It will be apparent to those skilled in the art that various modifications and variations can be made in the present invention without departing from the spirit or scope of the inventions.

That is, besides the seating ribs, there can be a variety of glass supporting means, which is formed at the front door frame, or both the front door frame and the rear door frame.

Mode for the Invention

FIG. 8 illustrates a perspective view of a drum type washing machine having a door in accordance with another preferred embodiment of the present invention provided thereto, FIG. 9 illustrates a section of the door in FIG. 8, FIG. 10 illustrates a plan view showing a state a door glass is mounted on the front door frame in FIG. 9, and FIG. 11 illustrates an enlarged perspective view of "A" in FIG. 10.

Referring to FIG. 8, the drum type washing machine includes a cabinet 152, a tub (not shown), a drum 156, lifters 158, a motor (not shown) mounted on a rear of the tub for driving the drum 156, a cabinet cover 164 having a laundry opening 162, a door 170, a gasket 166, and a safety cover 179.

The door includes a door frame 172, a door hinge assembly 178, a door glass 176, a door hook assembly 178 for hooking at the hook hole 165.

The door frame 172 includes a front door frame 180, a rear door frame 190. At a front of the front door frame 180, there is a hand grip 186.

An edge portion 177 of the door glass 176 is compressed and held by the front door frame 180 and the rear door frame 190 as the edge portion 177 is seated in, and supported on, seating portions 200 formed in an inside circumferences of the front door frame 180 and the rear door frame 190 such that the door glass 176 is arranged between the front door frame 180 and the rear door frame 190, and the front door frame 180 and the rear door frame 190 are fastened with fastening members (not shown).

The seating portion 200 includes seating ribs 202 formed on a front surface of the front door frame 180 and on a rear surface of the rear door frame 190 in circumferential directions respectively, so that the door glass 176 is arranged on an inside of the seating ribs 202 and a circumference of the edge portion 177 of the door glass 176 is in contact with an inside surface of the seating ribs 202.

The seating rib 202 includes a front seating rib 182 formed on the rear of the front door frame 80 along a circumference thereof in a circumferential direction, and a rear seating rib 192 formed on the front of the rear door frame 190 along a circumference thereof in a circumferential direction so as to be placed in, and fit to the front seating rib 182.

The front seating rib 182 is projected backward from the rear of the front door frame 180 at a predetermined height, as well as forms a circle along the front door frame 180, and has the circumference of the edge portion 177 of the door glass 176 in contact with an inside surface thereof.

The rear seating rib 192 is projected forward from the front of the rear door frame 190 at a predetermined height, as well as forms a circle along the rear door frame 190, and has an outside surface of the front seating rib 182 in close contact with an inside surface thereof.

That is, the front seating rib 182 is placed in, and fit to the rear seating rib 192 as the front door frame 180 and the rear door frame 190 are coupled.

The front seating rib 182 has a first stopper 184 projected outwardly from an outside surface along a circumference thereof, and the rear seating rib 192 has a second stopper 194 projected inwardly from an inside surface along a circumference thereof for holding the first stopper 184. As the first stopper 184 and the second stopper 194 are held together, the breaking away of the front seating rib 182 and the rear seating rib 192 is prevented.

In the meantime, because both the front seating rib 82 and the rear seating rib 92 are thin so that no shrinkage imbalance is caused in injection molding of the door frame 72, and form circles along circumferences and elongated in a direction perpendicular to surfaces of the frames, leading strength of the front seating rib 82 and the rear seating rib 92 inadequate, there are reinforcing members 204 provided at an inside surface of the front seating rib 192 for reinforcing strength or rigidity, as well as guiding mounting of the door glass 176, additionally.

The reinforcing members 204 are a plurality of reinforcing ribs 204 injection molded as one body with the front seating rib 182 of the front door frame 180 at an inside surface thereof, for reinforcing strength of the front seating rib 182, and guiding mounting of the door glass 176 to a right position at the front door frame 180.

A plurality of reinforcing ribs 204 are projected from an inside surface of the front seating rib 182 toward the door glass 176, and arranged in a circumferential direction at regular intervals, respectively.

The reinforcing rib 204 is extended from the inside surface of the front seating rib 182 in up/down direction, and has a height enough to remove gap between the front seating rib 182 and the door glass 176.

That is, the reinforcing rib 204 is projected in a radial direction from the inside surface of the front seating rib 182, and is projected at a height such that an end thereof is in close contact with the edge portion 177 of the door glass 176. According to this, the edge portion 177 of the door glass 176 is supported on the plurality of reinforcing ribs 204, directly.

Another preferred embodiment of the present invention will be described.

FIG. 12 illustrates a perspective view of a drum type washing machine having a door in accordance with another preferred embodiment of the present invention provided thereto, FIG. 13 illustrates a section of the door in FIG. 12, FIG. 14 illustrates a plan view showing a state a door glass is mounted on the front door frame in FIG. 13, and FIG. 15 illustrates an enlarged perspective view of "A" in FIG. 14.

The drum type washing machine includes a cabinet 252, a tub (not shown), a drum 256, lifters 258, a motor (not shown), a cabinet cover 264 having a laundry opening 262, a door 270, and a gasket 266.

In the meantime, referring to FIGS. 12 to 15, the door includes a door frame 272, a door hinge assembly 274, a door glass 276, and a door hook assembly 278 for hooking at the hook hole 265 in the cabinet cover 264.

The door frame 272, an injection molding of synthetic resin, includes a front door frame 280, a rear door frame 290. At a front of the front door frame 280, there is a hand grip 286.

The door glass 176 has an edge portion 277 placed between, and held by the front door frame 280 and the rear door frame 290 for closing an opened center portion of the door frame 272, and a sloped surface 275 on an upper side for smooth circulation of the washing water and drying air.

The edge portion 277 of the door glass 276 is compressed, and held by the front door frame 280 and the rear door frame 290 as the edge portion 277 is seated in, and supported on, seating portions 300 formed in an inside circumferences of the front door frame 280 and the rear door frame 290 such that the door glass 276 is arranged between the front door frame 280 and the rear door frame 290, and the front door frame 280 and the rear door frame 290 are fastened together with fastening members (not shown).

The seating portion 300 includes seating ribs 302 formed on a front surface of the front door frame 280 and on a rear surface of the rear door frame 290 in circumferential directions respectively, so that the door glass 276 is arranged on an inside of the seating ribs 302 and a circumference of the edge portion 277 of the door glass 276 is in contact with an inside surface of the seating ribs 302.

The seating rib 302 includes a front seating rib 282 formed on the rear of the front door frame 280 along a circumference thereof in a circumferential direction, and a rear seating rib 292 formed on the front of the rear door frame 290 along a circumference thereof in a circumferential direction so as to be placed in, and fit to the front seating rib 282.

The front seating rib 282 is projected backward from the rear of the front door frame 280 at a predetermined height, as well as forms a circle along the front door frame 280, and has the circumference of the edge portion 277 of the door glass 276 in contact with an inside surface thereof.

The rear seating rib 292 is projected forward from the front of the rear door frame 290 at a predetermined height, as well as forms a circle along the rear door frame 290, and has an outside surface of the front seating rib 282 in close contact with an inside surface thereof.

Both the front seating rib 282 and the rear seating rib 292 are formed thin so that no shrinkage imbalance is caused in injection molding of the door frame 272, and the front seating rib 282 fits in the rear seating rib 292.

The front seating rib 282 has a first stopper 284 projected outwardly from an outside surface along a circumference thereof, and the rear seating rib 292 has a second stopper 294 projected inwardly from an inside surface along a circumference thereof for holding the first stopper 284. As the first stopper 284 and the second stopper 294 are held together, the breaking away of the front seating rib 282 and the rear seating rib 292 is prevented.

The door hook assembly 278 includes a hook 278*a* projected from the other side of the rear door frame 290 for placing in a hook hole 265 in the cabinet cover 264 when the door 270 is closed a handle (not shown) positioned at the hand grip 286 for rotating a hook 278*a* by the user, and a door switch 278*c* in rear of the hook hole 265 of the cabinet cover 264, for holding the hook 278*a* in the hook hole 265 for maintaining a closed state of the door 270 if required.

For preventing the door glass 276 in the door frame 272 from rotating, the door glass 276 has a rotation preventive projection 304 at a side of the edge portion 277 of the door glass 276, and the front seating rib 282 of the front door frame 272 has a rotation preventive recess 306 for placing the rotation preventive projection 304 therein.

The rotation preventive projection 304 is formed as one body with door glass 276 at the edge portion 277, and has a height not to rake interference with the rear seating rib 292 when the door glass 276 is mounted.

The rotation preventive projection 304 has opposite sides each sloped at a predetermined angle so that the rotation preventive projection 304 is placed in the rotation preventive recess 306 with easy at the time the door glass 276 is placed on the front seating rib 282.

The rotation preventive recess 306, a recess formed by cutting away one side of the front seating rib 282 for placing the rotation preventive projection 304, has a left edge 306*a* and a right edge 306*b* projected backward higher than other portions of the front seating rib 282 for enhancing a holding capability of the rotation preventive projection 304.

Therefore, if external force acts on the door glass 276 in a rotation direction, though the door glass 276 tends to rotate along an inside surface of the front seating rib 282, because the rotation preventive projection 304 is held at the opposite edges of the rotation preventive recess 306, rotation of the door glass 276 is prevented.

However, since the front seating rib 282 is thin with a low rigidity, if an external force higher than a certain magnitude acts on the door glass 276, the opposite edges 306*a* and 306*b* of the rotation preventive recess 306 deform outwardly by the rotation preventive projection 304, leading the rotation preventive projection 304 to breakaway from the rotation preventive recess 306, to make the door glass 276 to idle in the door frame 272.

In order to resolve such a problem, the rotation preventive recess 306 has reinforcing means formed thereon, for preventing the rotation preventive recess 306 from deforming.

The reinforcing means 308 are reinforcing ribs 308 at the opposite edges 306*a*, and 306*b* of the rotation preventive recess 306 each extended in an up/down direction and projected at a predetermined height toward the edge portion 277 of the door glass 276. According to this, the opposite edges 306*a* and 306*b* of the rotation preventive recess 306 have a strength reinforced by the reinforcing ribs 308, to improve rigidity on the whole.

It is preferable that the reinforcing ribs 308 each has a height smaller than a space between the edge portion 277 of the door glass 276 and the front seating rib 282 so that mounting of the door glass 276 is not interfered.

Moreover, the reinforcing rib 308 also serves as a guide for guiding smooth placing of the rotation preventive projection 304 in the rotation preventive recess 306.

Of course, if a projection is formed on the safety cover 279 to be placed in the rotation preventive recess 306 of the front seating rib 282 like the door glass 279, rotation of the safety cover 279 can be prevented.

INDUSTRIAL APPLICABILITY

The present invention relates to mechanical apparatuses, such as washing machines or dryers, for washing or drying laundry, and more particularly to a door on a mechanical apparatus, in which a window of the door can be mounted on a frame thereof fit thereto, and which can prevent the window from hanging down by gravity.

The present invention permits assembly even in a case assembly of the door window and the door frame is difficult due to fabrication tolerances or the like, rigid supporting of the door window without being hung by gravity, mounting of the door window in a predetermined direction by guiding mounting of the door window, and prevent the door window from rotating after the mounting.

The invention claimed is:

1. A door for a mechanical apparatus for washing or drying laundry comprising:

a front door frame;

a rear door frame;

a door window between the front door frame and the rear door frame; and a flexible seating rib comprising a front seating rib formed on the front door frame and a rear seating rib formed on the rear door frame, wherein the front seating rib is projected form the front door frame toward the rear door frame and the rear seating rib is projected form the rear door frame toward the front door frame, wherein the front seating rib is supported by the rear seating rib, and the edge portion of the door window is seated and supported on the front seating rib.

2. The door as claimed in claim 1, wherein the front seating rib further includes a first stopper and the rear seating rib further includes a second stopper for holding the first stopper.

3. The door as claimed in claim 1, wherein the front door frame or the rear door frame includes;

door window supporting means for supporting the edge portion of the door window to prevent the door window from hanging by a weight of door window.

4. The door as claimed in claim 1, wherein the seating rib includes a reinforcing rib for reinforcing strength or rigidity of the seating rib.

5. A door for a mechanical apparatus for washing or drying laundry comprising:

a front door frame;

a rear door frame;

a door window between the front door frame and the rear door frame;

a rotation preventive projection projected outwardly from an edge of the door window; and a rotation preventive recess formed on the front door frame or the rear door frame for accommodating the rotation preventive projection.

6. The door as claimed in claim 1, wherein one of the seating rib and the door window includes a rotation preventive recess, and the other one thereof includes a rotation preventive projection for placing in the rotation preventive recess.

* * * * *